US008936439B2

(12) United States Patent
Duong et al.

(10) Patent No.: US 8,936,439 B2
(45) Date of Patent: Jan. 20, 2015

(54) RADIAL TURBINE BACKFACE CURVATURE STRESS REDUCTION

(75) Inventors: Loc Quang Duong, San Diego, CA (US); Xiaolan Hu, San Diego, CA (US); Gao Yang, San Diego, CA (US); Anthony C. Jones, San Diego, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 684 days.

(21) Appl. No.: 13/179,611

(22) Filed: Jul. 11, 2011

(65) Prior Publication Data

US 2013/0017091 A1 Jan. 17, 2013

(51) Int. Cl.
*F01D 5/22* (2006.01)
*F01D 5/04* (2006.01)

(52) U.S. Cl.
CPC ..... *F01D 5/048* (2013.01); *F05D 2260/941* (2013.01)
USPC ..... 416/185

(58) Field of Classification Search
USPC ..... 416/179, 182, 183, 185, 186, 186 R, 234
See application file for complete search history.

(56) References Cited

U.S. PATENT DOCUMENTS

| | | | | |
|---|---|---|---|---|
| 3,030,071 | A | 4/1962 | Scheper, Jr. | |
| 4,292,807 | A | 10/1981 | Rannenberg | |
| 4,923,370 | A * | 5/1990 | Larson et al. | 416/95 |
| 6,805,534 | B1 | 10/2004 | Brittingham | |
| 7,189,062 | B2 * | 3/2007 | Fukizawa et al. | 416/185 |
| 7,270,518 | B2 | 9/2007 | Barb et al. | |
| 7,578,656 | B2 * | 8/2009 | Higgins et al. | 416/244 A |
| 2002/0187060 | A1 | 12/2002 | Decker et al. | |
| 2004/0062645 | A1 | 4/2004 | Decker et al. | |
| 2010/0129228 | A1 | 5/2010 | Strohl et al. | |

* cited by examiner

*Primary Examiner* — Richard Edgar
*Assistant Examiner* — Kayla McCaffrey
(74) *Attorney, Agent, or Firm* — Carlson, Gaskey & Olds, P.C.

(57) ABSTRACT

A turbine wheel is disposed about an axis and has a back having a separator disposed thereon, an inner undercut disposed between the separator and the axis, and an outer undercut disposed between the separator and an outer periphery of the back face. The inner undercut is defined by a first radius blending toward the axis and into a first flat section, and further defined by a second radius blending into the first flat section and into the separator.

21 Claims, 4 Drawing Sheets

RADIAL TURBINE BACKFACE CURVATURE STRESS REDUCTION

BACKGROUND

The subject matter disclosed herein relates generally to the field of turbine wheels and, in particular, to scallop curvature for a radial turbine wheel.

In the majority of gas turbine engines, a combustion chamber is provided between an air compressor means and a turbine wheel. When the engine is operated, fuel is mixed with compressed air from the compressor and the mixture is burned in the combustion chamber to provide hot gases that are directed through a nozzle against the blades of the turbine wheel to affect rotation thereof. The turbine wheel, in turn, powers the compressor and provides other functions like starting engines, powering generators, powering pneumatic systems etc. These turbine wheels may be subject to stresses.

SUMMARY

Disclosed is a turbine wheel disposed about an axis and having a back face including a plurality of lobes disposed about a periphery of the back face. The lobes define scalloped areas therebetween. The scalloped areas are further defined by a radius BR2 that blends into a first lobe and into a radius BR1 that also blends into a flat area.

Further disclosed is a turbine wheel disposed about an axis that has a back face including a plurality of lobes that are disposed about a periphery of the back face. The lobes define scalloped areas therebetween. The scalloped areas are further defined by a radius BR2 that blends into a first lobe and into a radius BR1 that also blends into a flat area. A blade extends from each lobe away from the back face.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION

Figure 1:
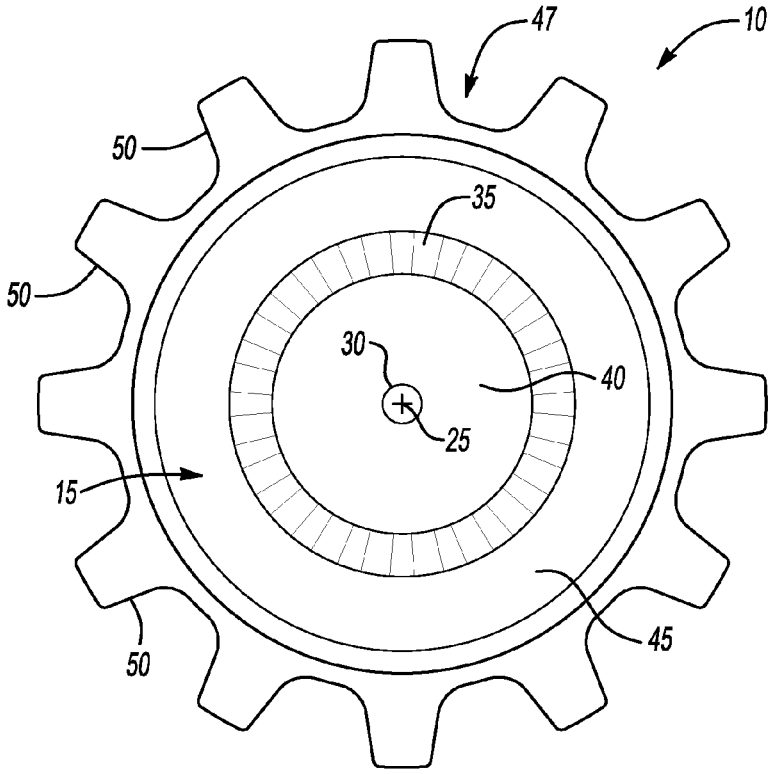
Fig-1 PRIOR ART
FIG. 1 is a back view of a prior art turbine wheel.
Figure 2:
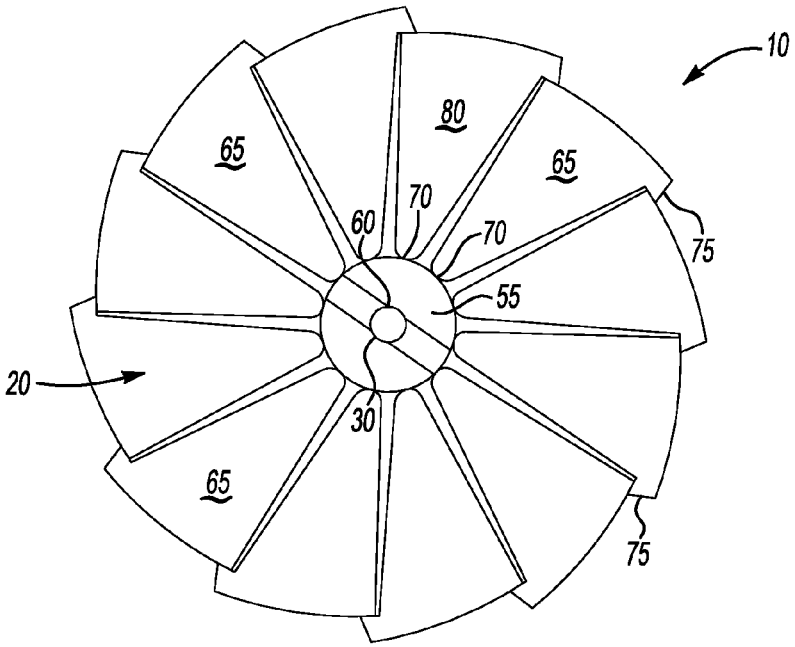
Fig-2 PRIOR ART
FIG. 2 is a front view of the turbine wheel of FIG. 1.
Figure 3:
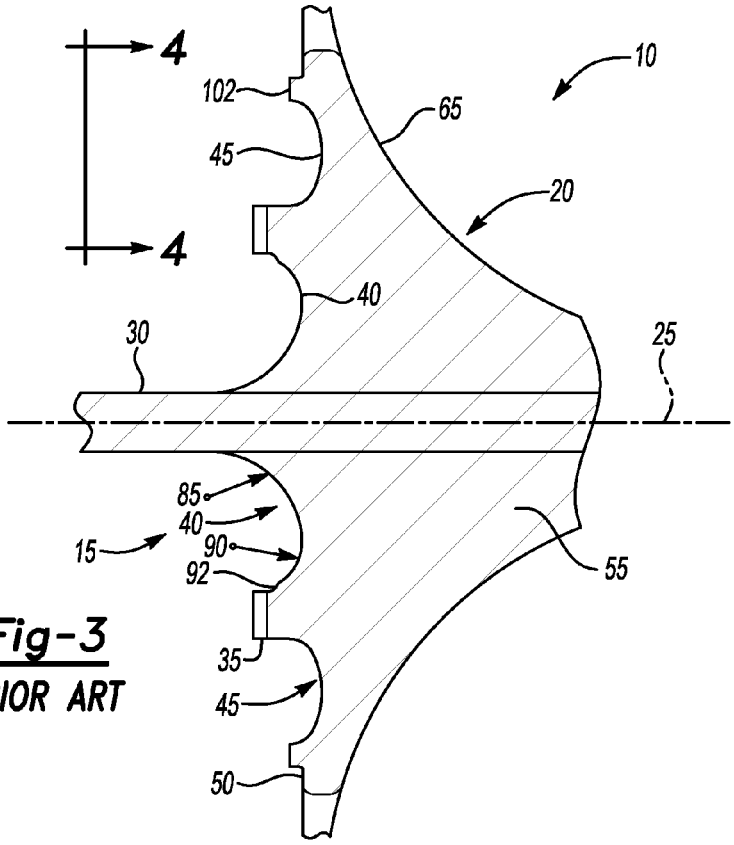
Fig-3 PRIOR ART
FIG. 3 is a side view of the turbine wheel of FIG. 1.

Referring to FIGS. 1-3 a prior art turbine wheel is shown. Turbine wheel 10 has a back 15, a front 20, a central axis 25 through which a tie bolt 30 extends. The back 15 has a circularly disposed gear 35 (e.g., a crown or face gear) that separates an inner undercut 40 between the tie bolt 30 and the gear 35 and an outer undercut 45 between the gear 35 and the outer periphery 47 of the turbine wheel 10. The turbine wheel 10 has a plurality of lobes 50 extending outwardly beyond the outer undercut 45. Though 12 lobes 50 are shown, other numbers of lobes are contemplated herein. The gear 35 also acts as a separator between the inner undercut 40 and the outer undercut 45.

Referring to the front 20 (see FIG. 2) of the turbine wheel 10, the front 20 has an outwardly extending hub 55. The hub 55 has a central opening 60 for receiving the tie bolt 30. A plurality of compound blades 65 extend outwardly from the front 20 of the turbine wheel 10 from an area corresponding to the lobes 50. The compound blades 65 each have a first side 70 extending from and integral with the lobe 50. The blades 65 also have a second side 75 intersecting the first side and attaching to and integral with the hub 55. The compound blades 65 each have a body 80 that has a compound curve that extends from a corresponding lobe 50 to extend upwardly and over, or nearly over, an adjacent lobe 50 as is known in the art.

Referring to the prior art example of FIG. 3, the inner undercut 40 as shown in the prior art has a first radius 85 of about 0.5 inches (about 1.27 cm) that curves upwardly into engagement with the tie bolt 30. A first radius 85 blends into a second radius 90 having a radius of about 0.25±0.01 inches (about 0.64±0.025 cm) that blends into a shoulder 92 abutting the gear 35.

Figure 4:
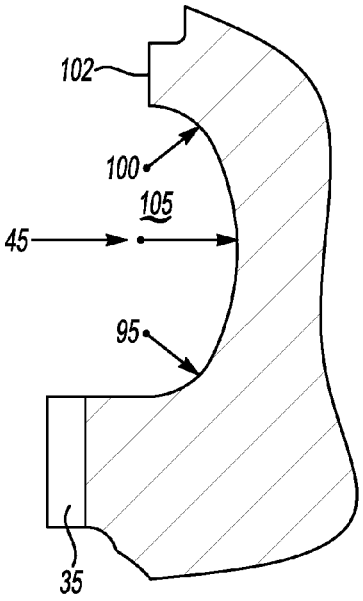
Fig-4 PRIOR ART
FIG. 4 is a prior art view of the area taken along the lines 4-4 of FIG. 3.

Referring now to the prior art example of FIG. 4, a first outer undercut radius 95 has a radius of about 0.130 inches (about 0.33 cm) that blends into the gear 35. Similarly, the outer undercut has a second outer undercut radius 100, also having a radius of about 0.130 inches (about 0.33 cm) that blends into a rim 102 that extends around the undercut. A third outer radius 105 of about 0.010 inches (about 0.025 cm) blends into each of the first outer undercut radius 95 and the second outer undercut radius 100.

Figure 4A:
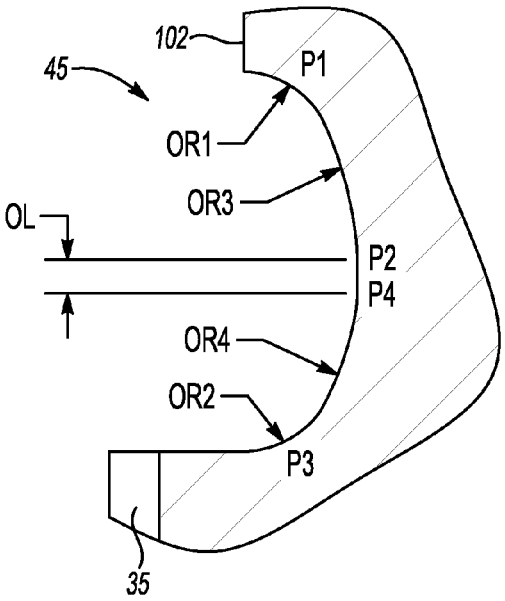
FIG. 4A is a view of FIG. 4 incorporating concept provided herein.

Referring now to FIG. 4A, as disclosed herein, an example of the outer undercut 45 is modified to have a first radius OR1 of about 0.130 inches (about 0.33 cm) blending into rim 102 at tangent point P1 and a second radius OR3 of about 0.495 inches (about 1.26 cm) that blends into the first radius OR1 and to a flat area OL at tangent point P2. Similarly, the outer undercut 45 has a third radius OR2 of about 0.10 inches (about 0.25 cm) blending into gear 35 at tangent point P3 and a fourth radius OR4 of about 0.495 inches (about 1.26 cm) that blends into the second radius OR2 and to flat area OL at tangent point P4. The flat portion OL is created between tangent point P2 and tangent P4 and has a length that is equal to about 0.0425 inches (about 0.11 cm). The flat length OL may also be greater than or equal to 0.13 times the radius of OR1. The ratio between radius OR4 to OR2 is about 4.95 to 1. Similarly, the ratio of radius OR4 to OR1 is about 3.8:1.

Figure 5:
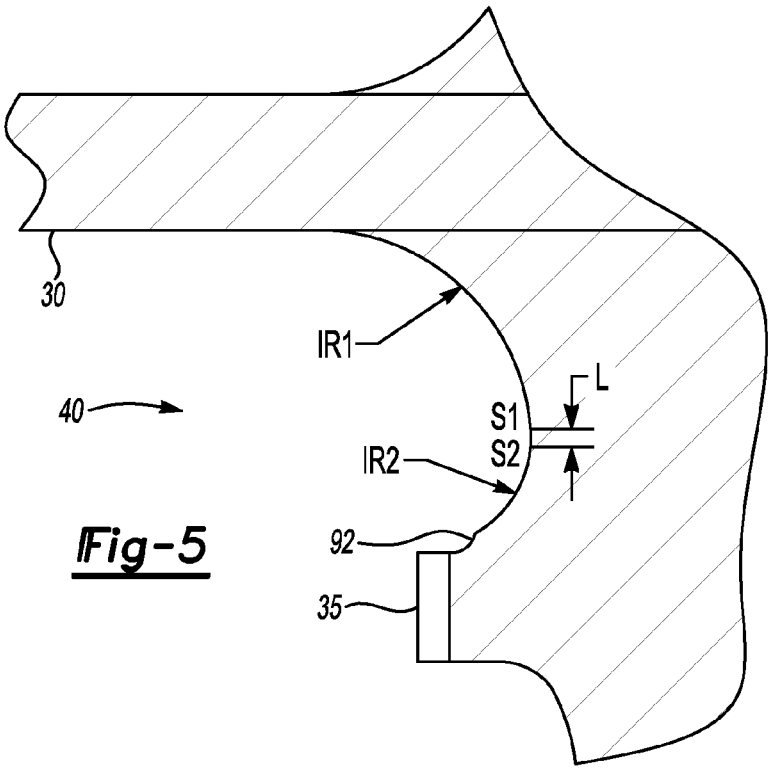
FIG. 5 is a schematic view of a portion of the tie rod incorporating concept of the invention as provided herein.

Referring now to FIG. 5, the inner undercut 40 with example dimensions is examined. The inner undercut 40 is defined by a radius IR1 of about 0.500 inches (about 1.27 cm) that ends at a tangent point S1 and blends into the tie bolt 30. The inner undercut 40 is also defined by a second radius IR2 of about 0.250 inches (about 0.64 cm) and extending, from tangent point S2 that blends into the shoulder 92 of the gear 35. The inner undercut 40 is defined by an inner undercut flat area L between radii IR1, IR2. The length of the flat area L is >0.1 times the second radius IR2 of about 0.25 inches (about 0.64 cm) or about 0.025 inches (about 0.064 cm). The ratio of the IR1 radius to the IR2 radius is about 2:1.

The Applicants have discovered that, given the high stresses experienced by prior art turbine wheels due to high pressure and temperature gradients thereof, crack propagation may be stimulated from one blade 65 to another which may result in segmenting the turbine wheel 10. By providing a large radius (e.g., an infinite or flat area OL, L) between the other radii minimizes abrupt rates of change of velocity that may occurs at an apex of curvature of the other radii which correspond to the location of the highest stress amplitudes. Crack propagation may then be minimized. The highest stress amplitudes are reduced if a flat area OL, L is placed between the convergent and divergent sides e.g., between IR1 and IR2 and between OR 3 and OR4 (see FIGS. 4A and 5) tangent to these two radii to the limit of flat length is a curve of infinite radius. A continuous curvature (see FIGS. 3 and 4), which may damagingly couple the stresses on both sides of the back of the wheel in one place, is minimized by the teachings herein.

Figure 6:
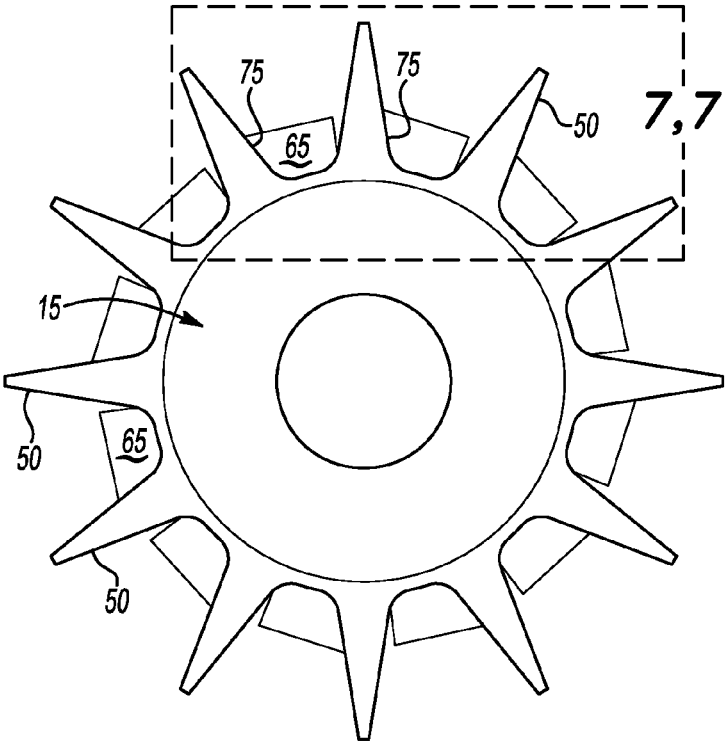
FIG. 6 is a schematic back view of a turbine wheel.
Figure 7:
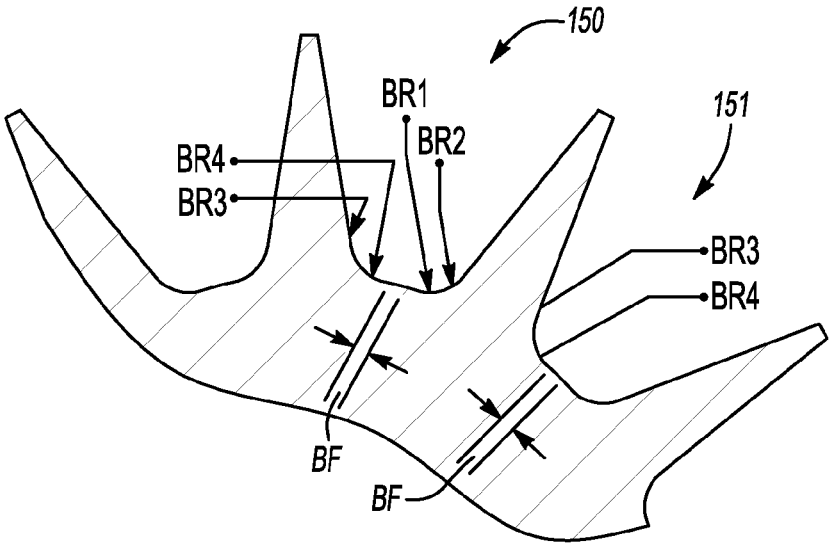
FIG. 7 is a figure taken along the line 7-7 of a turbine wheel as shown in FIG. 6.

Referring to FIGS. 6 and 7, a schematic example of back face 15 of the turbine wheel 10 is shown schematically. A scalloped area 150 in the back 15 of the wheel 10 between lobes 50 has a radius BR1 of about 0.398 inches (about 1 cm) which blends into a radius BR2 of about 0.10 inches (about 0.25 cm) that is compound in nature as will be discussed infra. Similarly the scalloped area 150 (also shown in an adjacent scalloped area 151 for ease of illustration) has a radius BR4 of about 0.398 inches (about 1 cm) which blends into a radius BR3 of about 0.10 inches (about 0.25 cm) that is also compound in nature as will be discussed infra. Radii BR1 and BR4 are also tangent to hub 55, and radii BR2 and BR3 are tangent to lobes 50. A flat area BF of about 0.06 inches (about 0.15 cm) is disposed between the BR1 and BR4 radii. The BR1 and BR4 radii are larger to provide minimal stress in the tangential direction as the turbine wheel 10 rotates. A ratio between BR1 and BR2 and BR4 and BR3 is about 3.98:1.

It will be understood that the example dimensions BR1, BR2, BR3, BR4, and BF are scalable to maintain the reduced stress configuration described herein. For example, a stress reduction of about 10% over the prior art can be achieved when BF is between about 0.04 inches (about 0.1 cm) and about 0.06 inches (about 0.15 cm). Radii BR1 and BR2 have a common tangent point. Similarly, radii BR3 and BR4 have a common tangent point. Radius BR1 may be greater than or equal to three times radius BR2. Radius BR4 may be greater than or equal to three times radius BR3.

Figure 8:
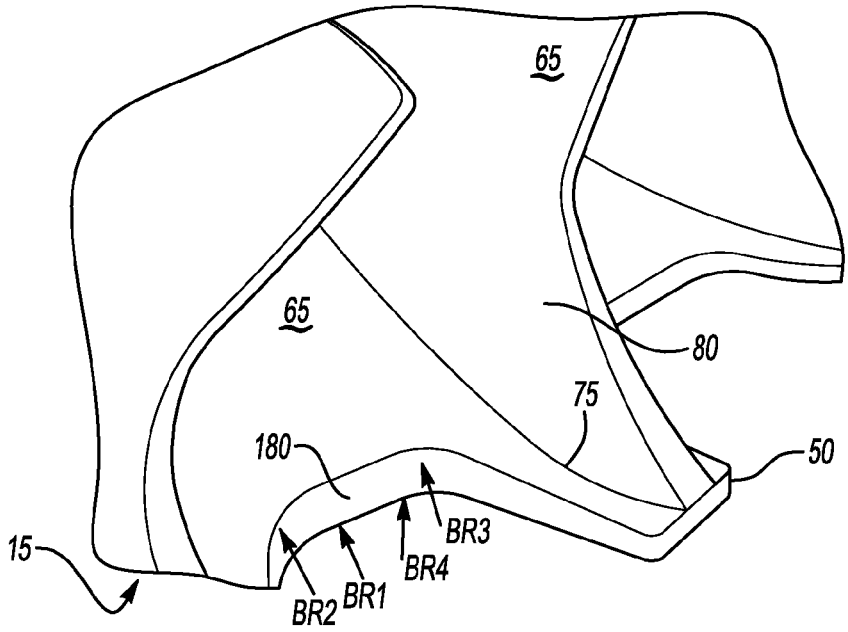
FIG. 8 is a schematic side view of the turbine wheel of FIG. 7.

Referring to FIG. 8, a chamfered area 180 of each blade 65 is shown. The BR1 and BR4 radii cut into the back 15 in plane with the back 15 as do the BR2 and BR3 radii. However the BR2 and BR3 radii also cut upwardly out of plane into the chamfered area 180 to provide a minimization of stress while creating the flat area BF and not undermining the blades 65.

The turbine wheel 10 may experience high tensile and compressive stresses in the scalloped area 150 during start up and shut down of an engine (not shown). During start up, the portion of the blades 65 near the scalloped areas 150 warms up faster than the hub 55, which may cause high compressive thermal stresses at the scalloped areas 150. During shut down, the blades 65 in the scalloped areas 150 cool down faster than the hub 55 which may cause high tensile thermal stresses in the scalloped areas 150. The further imposition of centrifugal stresses, results in the scalloped areas 150 further experiencing high compressive stresses during start up and high tensile stresses during shut down while the hub 55 experiences relatively less tensile stresses during start up and less compressive stresses during shut down. However, by providing a flat area BF between BR1 and BR4 radii and providing compound radii BR2 and BR3 that blend into the blades 65, compressive, centrifugal, tensile and thermal stresses may be lessened.

In general, along the stress trajectory on the surface of the solid body, a smooth and continuous curve of different curvatures, including a flat area BF, may be required to avoid the abrupt raise in the strain rate. For the turbine wheel scallop applications, a curve featuring the compound radii BR2, BR3 are used to alleviate the stress that a one-dimensional radius does not accommodate.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments. For example, the features described and depicted in reference to FIGS. 4A and 5 may be implemented independently of the features described and depicted with respect to FIGS. 7 and 8, with either option resulting in stress reduction. Conversely, a turbine wheel may be constructed that includes a combination of the features described and depicted in the combination of FIGS. 4A-8.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A turbine wheel disposed about an axis, said turbine wheel comprising:

a back having a separator disposed thereon and an outer rim;

an inner undercut disposed between said separator and said axis; and an outer undercut disposed between said separator and an outer periphery of said back, wherein said inner undercut has a first radius, a second radius and a flat area, said first radius blending toward said axis and into said first flat section, and said second radius blending into said first flat section and into said separator, and wherein said outer undercut includes a first outer radius (OR1), a second outer radius (OR2), a third outer radius (OR3), a fourth outer radius (OR4) and a second flat area, said first outer radius (OR1) blending into said outer rim and said third outer radius (OR3), said third outer radius (OR3) blending into said second flat section, said second outer radius (OR2) blending into said separator and said fourth outer radius (OR4), and said fourth outer radius (OR4) blending into said second flat section, and each surface of said outer undercut defined by said first outer radius (OR1), said second outer radius (OR2), said third outer radius (OR3), and said fourth outer radius (OR4) is concave.

2. The turbine wheel of claim 1 wherein a ratio between said first radius and said second radius is about 2:1.

3. The turbine wheel of claim 1 wherein a surface of said inner undercut defined by said second radius blends into a shoulder of said separator.

4. The turbine wheel of claim 1 wherein a length defined by said first flat section is greater than or equal to 0.1 times the second radius.

5. The turbine wheel of claim 1 wherein said separator is a crown gear.

6. The turbine wheel of claim 1 wherein a surface of said inner undercut defined by said first radius blends into a tie rod disposed about said axis.

7. The turbine wheel of claim 1 wherein said third outer radius (OR3) and said fourth outer radius (OR4) are equal.

8. The turbine wheel of claim 1 wherein a length defined by said second flat section is equal to or greater than 0.13 times said second outer radius (OR2).

9. The turbine wheel of claim 1 wherein a ratio of said fourth outer radius (OR4) to said second outer radius (OR2) is about 4.95:1.

10. The turbine wheel of claim 1 wherein a ratio of said fourth outer radius (OR4) to said first outer radius (OR1) is about 3.8:1.

11. The turbine wheel of claim 1, wherein each surface of said inner undercut defined by said first and second radii is concave.

12. The turbine wheel of claim 1, wherein a first surface of said inner undercut defined by said first radius extends a first arc length, and a second surface of said inner undercut defined by said second radius extends a second arc length.

13. The turbine wheel of claim 1, wherein said first outer radius (OR1) and said third outer radius (OR3) together define a first compound curve, and said second outer radius (OR2) and said fourth outer radius (OR4) together define a second compound curve.

14. A turbine wheel disposed about an axis, said turbine wheel comprising:

a back having an outer periphery and an outer rim; and a first undercut disposed between said outer periphery and said axis, wherein said first undercut has a first radius, a second radius and a flat section, said first radius blending toward said axis and into said first flat section, and said second radius blending into said first flat section and toward said outer periphery; and a second undercut disposed between said first undercut and said outer rim having a first outer radius (OR1), a second outer radius (OR2), a third outer radius (OR3), a fourth outer radius (OR4) and a second flat section, said first outer radius (OR1) blending into said outer rim and said third outer radius (OR3), said third outer radius (OR3) blending into said second flat section, said second outer radius (OR2) blending into a separator between said first and second undercuts, and said fourth outer radius (OR4) blending into said second flat section, and each surface of second undercut defined by said first outer radius (OR1), said second outer radius (OR2), said third outer radius (OR3) and said fourth outer radius (OR4) is concave.

15. The turbine wheel of claim 14 wherein a ratio between said first radius and said second radius is about 2:1.

16. The turbine wheel of claim 15 wherein a length defined by said first flat section is greater than or equal to 0.1 times the second radius.

17. The turbine wheel of claim 14 wherein a length defined by said second flat section is equal to or greater than 0.13 times said second outer radius (OR2).

18. The turbine wheel of claim 14 wherein a ratio of said fourth outer radius (OR4) to said second outer radius (OR2) is about 4.95:1.

19. The turbine wheel of claim 14, wherein each surface of first undercut defined by said first and second radii is concave.

20. The turbine wheel of claim 14, wherein a first surface of said first undercut defined by said first radius extends a first arc length, and a second surface of said first undercut defined by said second radius extends a second arc length.

21. The turbine wheel of claim 14, wherein said first outer radius (OR1) and said third outer radius (OR3), together define a first compound curve, and said second outer radius (OR2) and said fourth outer radius (OR4) together define a second compound curve.

* * * * *

UNITED STATES PATENT AND TRADEMARK OFFICE

CERTIFICATE OF CORRECTION

PATENT NO. : 8,936,439 B2
APPLICATION NO. : 13/179611
DATED : January 20, 2015
INVENTOR(S) : Loc Quang Duong It is certified that error appears in the above-identified patent and that said Letters Patent is hereby corrected as shown below:

IN THE CLAIMS:

In claim 1, column 4, line 36; prior to "flat" insert --first--

In claim 1, column 4, line 42; delete "area" and insert --section--

In claim 14, column 5, line 27; prior to "flat" insert --first--

In claim 19, column 6, line 22; after "surface of" insert --said--

Signed and Sealed this
Twenty-seventh Day of October, 2015

Michelle K. Lee

Michelle K. Lee
*Director of the United States Patent and Trademark Office*